US010214976B2

(12) United States Patent
Chang et al.

(10) Patent No.: US 10,214,976 B2
(45) Date of Patent: Feb. 26, 2019

(54) PIPE HANDLING DEVICE

(71) Applicant: Veristic Technologies, Inc., Houston, TX (US)

(72) Inventors: Aaron Chang, Houston, TX (US); Brian Cunningham, Pearland, TX (US); Charles Vora, Bellaire, TX (US)

(73) Assignee: Veristic Technologies, Inc., Houston, TX (US)

( * ) Notice: Subject to any disclaimer, the term of this patent is extended or adjusted under 35 U.S.C. 154(b) by 0 days.

(21) Appl. No.: 15/909,753

(22) Filed: Mar. 1, 2018

(65) Prior Publication Data

US 2018/0187497 A1 Jul. 5, 2018

Related U.S. Application Data

(62) Division of application No. 15/144,393, filed on May 2, 2016.

(60) Provisional application No. 62/155,932, filed on May 1, 2015.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/14; E21B 19/15; E21B 19/143; E21B 19/146
USPC ..... 414/22.54
See application file for complete search history.

(56) References Cited

U.S. PATENT DOCUMENTS 4,650,237 A 3/1987 Lessway
4,759,414 A * 7/1988 Willis ..... E21B 15/00 173/185
4,834,604 A * 5/1989 Brittain ..... E21B 19/155 175/85
5,458,454 A * 10/1995 Sorokan ..... E21B 19/155 166/77.52
5,660,087 A 8/1997 Rae
7,289,871 B2 * 10/2007 Williams ..... E21D 20/003 175/40
7,707,914 B2 * 5/2010 Pietras ..... E21B 19/163 81/57.16
8,011,426 B1 * 9/2011 Orgeron ..... B25B 5/061 166/77.51
8,235,104 B1 * 8/2012 Sigmar ..... E21B 19/164 166/380
8,419,335 B1 * 4/2013 Orgeron ..... F16L 1/065 212/255
8,474,806 B2 * 7/2013 Orgeron ..... B25B 5/061 269/218
9,500,049 B1 * 11/2016 Orgeron ..... E21B 19/155
9,556,689 B2 * 1/2017 Orgeron ..... E21B 19/155

(Continued)

OTHER PUBLICATIONS https://www.f-e-t.com/products/drilling-and-subsea/drilling/tubular-handling/catwalks "Catwalks", Forum Energy Technologies, © 2018, 2 pages, printed Oct. 25, 2018.

(Continued)

*Primary Examiner* — Patrick H Mackey
(74) *Attorney, Agent, or Firm* — Christopher McKeon; Arnold & Saunders, LLP

(57) ABSTRACT

The present invention relates to a tubular handling system for maneuvering tubulars onto or off of a rig and including a tubular grip adapted to engage a variety of tubular sizes.

17 Claims, 8 Drawing Sheets

(56) References Cited

U.S. PATENT DOCUMENTS

2008/0174131 A1* 7/2008 Bouligny ..... E21B 19/07
294/197
2008/0253866 A1* 10/2008 Lops ..... E21B 19/155
414/22.55

OTHER PUBLICATIONS https://www.nov.com/Segments/Rig_Systems/Land/Pipe_Handling/Horizontal_Pipe_Handling/PipeCat_Laydown_System.aspx "Pipecat Laydown System", National Oilwell Varco, © 2018, 2 pages, printed Oct. 25, 2018.
https://www.nabors.com/equipment/automated-surface-equipment/automated-catwalks "Automated Catwalks", Nabors Industries Ltd., © 2018, 4 pages, printed Oct. 25, 2018.
http://www.drillmec.com/en/p/ahead-rigs-2016/ "AHEAD Rigs—the evolution of Hydraulic Rigs", Drillmec Drilling Technologies, © 2016, 11 pages.
http://www.mdcowan.com/rigs_pipehandlers.html "Rigs", MD Cowan, © 2011, 1 page, printed Oct. 25, 2018.
Pneumatics vs. Hydraulics Part ii—Hydraulics Overview, Mar. 3, 2014, http://blog.worldwidemetric.com/trade-talk/pneumatics-vs-hydraulics-part-ii-hydraulics-overview/ (Year: 2014).

* cited by examiner

PIPE HANDLING DEVICE

RELATED APPLICATIONS

This application is a divisional of U.S. application Ser. No. 15/144,393, filed May 2, 2016, which claims priority to U.S. Provisional Application No. 62/155,932, filed May 1, 2015.

BACKGROUND OF THE INVENTION

Oilfield operations on rigs require the use of tubulars to perform tasks such as drilling, provide pipe for drilled wellbores, casing for drilled wellbores, and exploration. Tubulars are constantly being moved on the rig floor, on and off the rig floor, coupled to one another, uncoupled, placed into the wellbore, and pulled out of the wellbore. The constant moving and manipulation of tubulars on a rig poses a safety hazard to the workers on the rig, slows operations, and requires careful choreography with all the moving equipment.

Moving tubulars on and off the rig floor presents a different set of challenges. The rig floor is on top of a substructure that is elevated above the ground. Tubulars for a specific jobs have to be hoisted from the ground and up onto the rig floor. This is often accomplished manually by workers, chains, and hoisting machinery. Pipe can be stacked horizontally onto a skid at the base of the rig, dragged up a pipe slide using a chain or cable, and placed vertically on the rig floor. This process is time consuming and presents a safety hazard to the workers on the rig. After tubulars are no longer needed, they are lowered on the pipe slide and allowed to slide back onto the pipe skid.

There exist a need to provide a fully automated system for maneuvering tubulars on and off the rig floor.

SUMMARY OF EXAMPLES OF THE INVENTION

The present invention is a pipe handling device that can automatically move tubulars, such as pipe, casing, etc, on or off a rig floor in one continuous movement. An example embodiment of this design is a pipe handler comprising a gripper, an arm, a stabilizer coupled to the arm, a body portion and legs. The legs are coupled to the body portion and the arm is also coupled to the body portion. A plurality of actuators are distributed throughout the machine in order to articulate the desired motion of the pipe handler.

As shown in the example figures below, one or more actuators are coupled between the legs and the middle body portion, controlling the motion of the body portion with respect to the legs. Another set of actuators may be located between the arm and the body portion and control the motion of the arm with respect to the body portion. A further one or more actuators controls motion of the stabilizer with respect to the arm.

The gripper device is located on the stabilizer. Its function is to physically grab the pipe being moved and secure it with respect to the stabilizer. The gripper device is a two jaw setup adapted to fit various sized tubulars from about an outer diameter of 3.5 inches to 20 inches, by way of example. A plurality of actuators control the jaw. The inside of the jaw is designed to interface with the pipe using a single contoured radius that may have a polyethylene or equivalent non-marring material lining the inner surface of the jaw. The advantage of this particular design is that it utilizes two actuators. At least one example embodiment uses two actuators to prevent binding when picking up a pipe and to reduce the complexity of the system.

An example of a method for using the invention may include a method for drilling. During a drilling operation, a new pipe joint can be transferred from the pipe rack to the mouse hole using the pipe handler disclosed. The method of operation includes using a touch screen controlled by a driller to send a command to a programmable logic controller (PLC) that a new pipe is needed. The PLC will issue a series of commands to a motion controller that will manipulate the plurality of actuators located throughout the pipe handler to allow it to grab the desired pipe laying horizontal with the gripper, raise the pipe handler to a vertical position such that the pipe is now vertical, and then translate the pipe handler towards the mouse hole on a rig floor, positioning the pipe vertically above the mouse hole, lowering the pipe into the mouse hole, releasing the pipe, and then clearing the rig floor, all in a single continuous movement. After releasing the pipe the pipe handler will retract to its original starting position. Picking up a pipe from the mouse hole and placing it on the pipe rack operates the opposite way and it can still be initiated from a command by the operator. The pipe handler can also bring or remove pipe from the well center if desired rather than the mouse hole. This process can be used in a drilling operation, a tripping operation, pickup and law down operation for casing, or any other operation utilizing tubulars.

An example of an embodiment may include an apparatus for gripping a tubular having a bottom plate having a base end and a grip end, a top plate located parallel and substantially aligned with the bottom plate, and having a base end and a grip end, a first grip arm with a first end and a second end, pivotally coupled to the bottom plate and the top plate, said first grip arm pivoting about a first axis located between the first and second ends, a second grip arm with a first end and a second end, pivotally coupled to the bottom plate and the top plate, said second grip arm pivoting about a second axis located between the first and second ends, a first actuator coupled proximate to the first end of the first grip, and further coupled proximate to the base ends of the bottom plate and the top plate, a second actuator coupled proximate to the first end of the second grip, and further coupled proximate to the base ends of the bottom plate and the top plate.

A variation of the example embodiment may include at least one friction roller proximate to the second end of the first grip arm and being substantially perpendicular to the bottom plate and top plate. It may include at least one friction roller proximate to the second end of the second grip arm and rotating around an axis that is substantially perpendicular to the bottom plate and top plate. It may include at least one friction roller is a plurality of friction rollers. It further may include at least one friction roller being a plurality of friction rollers. It may include at least one friction roller located proximate between the grip ends of the top plate and the bottom plate. It may include the at least one friction roller located proximate between the grip ends of the top plate and the bottom plate being a plurality of friction rollers. It may include the first actuator and second actuator being hydraulic cylinders. It may further include the grip arms being adapted to engage a tubular having a center axis and restraining axial movement along the center axis with respect to the first and second grip arms while providing rotational movement about the center axis.

A variation of the example embodiment may include the first grip arm friction roller, the second grip arm friction roller, and the plurality of friction rollers mounted between the top plate and bottom plate engaging a tubular between 3.5 inches and 20 inches in diameter. The tubulars may be casing, pipe, or downhole tools. The first actuator and second actuator may both have a base end that is pinned between the top plate and the bottom plate. The top and bottom plate may both have a concave shape on one end. The bottom plate and top plate may have a Y-shaped configuration. The first actuator and second actuator may be servo motors.

An example embodiment for handling tubulars may include a skid having a first end and a second end, at least one leg having a lower end rotatingly coupled to the first end of the skid and an upper end, at least one beam having a first end rotatingly coupled to the upper end of the at least one leg and being free to rotate about the coupling and a distal end, a first actuator coupled to the skid, between the first end and the second end, and the at least one leg, between the lower end and the upper end, a second actuator coupled to the at least one leg, between the upper end and the first actuator coupling, and the at least one beam, between the first end and the distal end, an arm with a top end, a gripper end, a first pivot coupling located between the base end and the gripper end and coupled proximate to the distal end of the at least one beam, a third actuator connected proximate to the top end of the arm and the at least one beam, between the first end and the distal end, and a tubular gripper attached to the gripper end of the arm adapted to grip a tubular.

A variation of the example embodiment may include a stabilizer bar having a coupled end connected to the arm proximate to the first pivot coupling of the arm and having a gripper end with a second tubular gripper attached therein. It may include the first tubular gripper and the second tubular gripper are parallel. It may include a fourth actuator coupled to the stabilizer proximate to the coupled end and the arm proximate to the top end. It may include the plurality of actuators being hydraulic cylinders. It may include the at least one leg being a plurality of legs. It may include the at least one beam being a plurality of beams. It may include one or more grippers as described herein.

An example embodiment of a method for handling tubulars on a rig may include gripping a tubular with a center axis, at a first location, translating a tubular in a vertical direction, rotating the tubular, translating the tubular in a horizontal direction towards a target location, lowering the tubular at the target location, and releasing the tubular at the target location. The tubular may be positioned either horizontally or vertically when gripped. The tubular may be rotated from a horizontal orientation to a vertical orientation or a vertical orientation to a horizontal orientation. The tubular may be gripped at a plurality of locations along the axial length of the tubular. The first location may be adjacent to a rig floor, or on the rig floor. The target location may be on a rig floor or adjacent to a rig floor. The tubular may be moved from a higher elevation to a lower elevation, or vice versa. The tubular may be rotated about its center axis while gripped. The tubular may be axially fixed to the gripper and unable to slide through the gripper while gripped. The target location may be a mouse hole on a rig floor, the turntable, pipe rack, or a borehole. The first location may be a mouse hole on a rig floor, the turntable, pipe rack, or a borehole.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures. Briefly.

DETAILED DESCRIPTION OF EXAMPLES OF THE INVENTION

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the appended claims.

Figure 1:
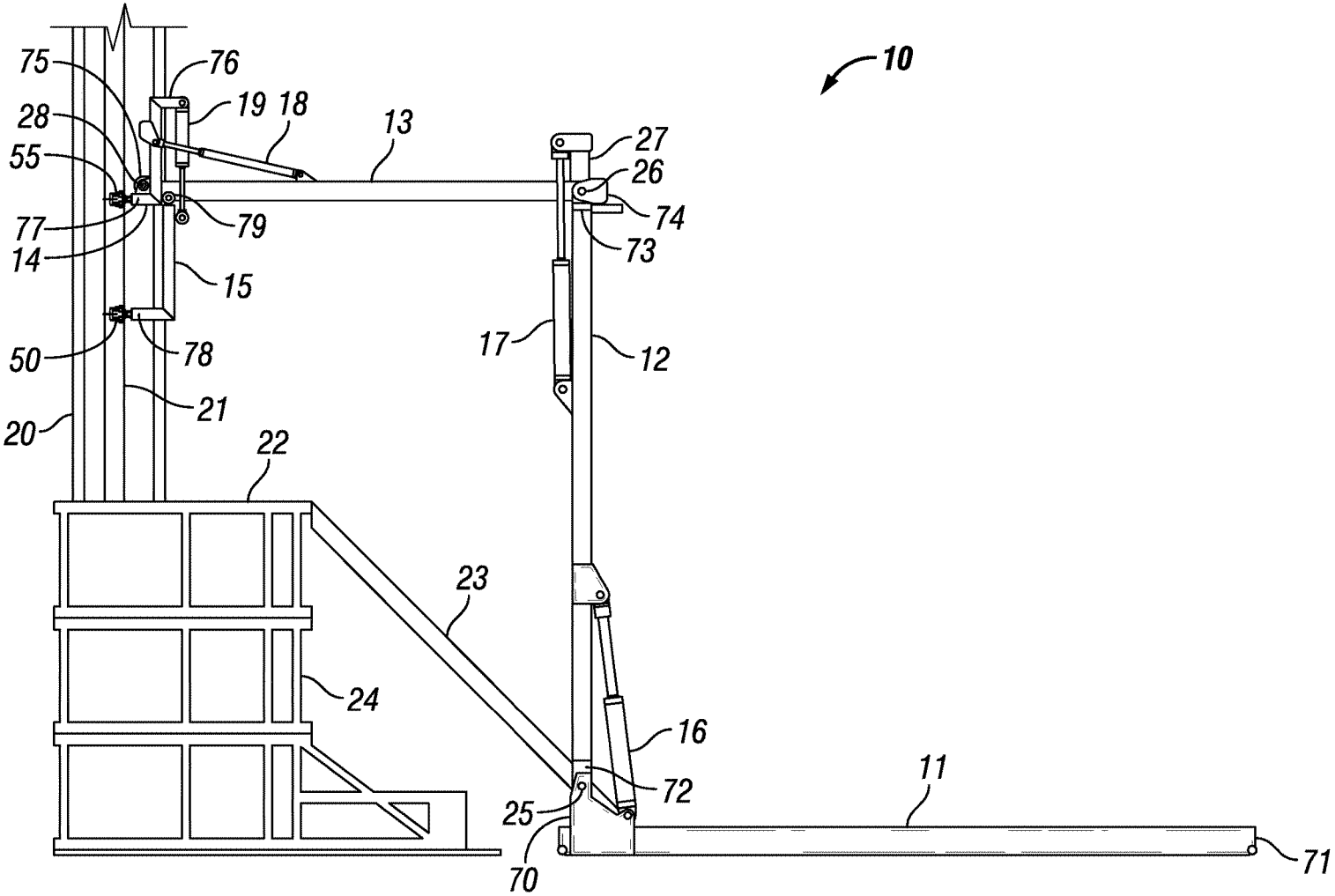
FIG. 1 is a side view of an example embodiment of a pipe handler.

An example of the invention is illustrated in FIG. 1 which depicts the pipe handler 10. The pipe handler 10 is located at a pipe station adjacent to rig 24 with mast 20 and pipe slide 23. The pipe handler 10 has a skid 11 for a base with a first end 70 located proximate to the rig 24 and a second distal end 71. The leg 12 is bolted to the skid 11 via leg pivot 25. Leg 25 has a lower end 72 and an upper end 73. Leg pivot 25 is located proximate to lower end 25 and may be a pin, bearing, or other well known coupling mechanism. The leg 12, which may be one or more beams, rotates about the leg pivot 25 proximate to the first end 70 of the skid 11. The leg actuator 16, which may be a plurality of actuators, is coupled to the leg 12, between the lower end 72 and the upper end 73, and the skid 11 proximate to the first end 70. The leg actuator 16 manipulates the angular position of the leg 12 with respect to the skid 11.

Further referring to FIG. 1, the leg 12 is coupled to a body 13 via body pivot 26. Body 13 may be one or more parallel beams. Body 13 has a first end 74 and a distal end 75. The body actuator 17, which may be a plurality of actuators, is coupled to the body 13 via extension 27. Body actuator 17 is mounted to the leg, between the upper end 74 and the actuator 16 coupling point. Extension 27 is welded, bolted, or otherwise fixed to the body 13 and is proximate to the first end 74. Extension 27 allows body actuator 17 to apply the necessary torque during the entire range of motion of the body 13 with respect to the leg 12. For instance, in moving a tubular 21 from a vertical position above the rig floor 22 to a horizontal position above the skid, the body 13 will have to move through the same plane as leg 12. Extension 27, which may be a plurality of extensions connected to body 13, allows the actuator 17 to maintain precise positive control of the body 13 through this range of motion without a sudden loss of torque when the body 13 aligns with the leg 12. The body actuator can manipulate body 13, causing it to rotate about the body pivot 26. Body pivot 26 may be a pin, bearing, or some other well known coupling mechanism. Body 13 is connected to the arm 14 via arm pivot 28. Arm pivot 28 may be a pin, bearing, or some other well known coupling means that allows for rotation between two members. Arm 14 has a top end 76 and a gripper end 77.

Still referring to FIG. 1, arm 14 has an upper gripper 55 that is adapted to hold a variety of tubulars 21. Gripper 55 is proximate to the gripper end 77. Stabilizer arm 15 is used to provide stability when handling tubulars and includes a lower gripper 50 attached to the gripper end 78 of the stabilizer arm 15. Upper gripper 55 and lower gripper 50 may be the same design and will be discussed in further detail below. Stabilizer actuator 19, which may be a plurality of actuators, manipulates stabilizer arm 15 in relation to the arm 14. Stabilizer actuator 19 is attached to the top end 76 of arm 14 and proximate to the top end 79 of stabilizer arm 15. Actuator 18, which may be a plurality of actuators, is attached to the arm 14 between the gripper end 77 and top end 76. Actuator 18 is further attached to the body 13, between first end 74 and distal end 75.

Figure 2:
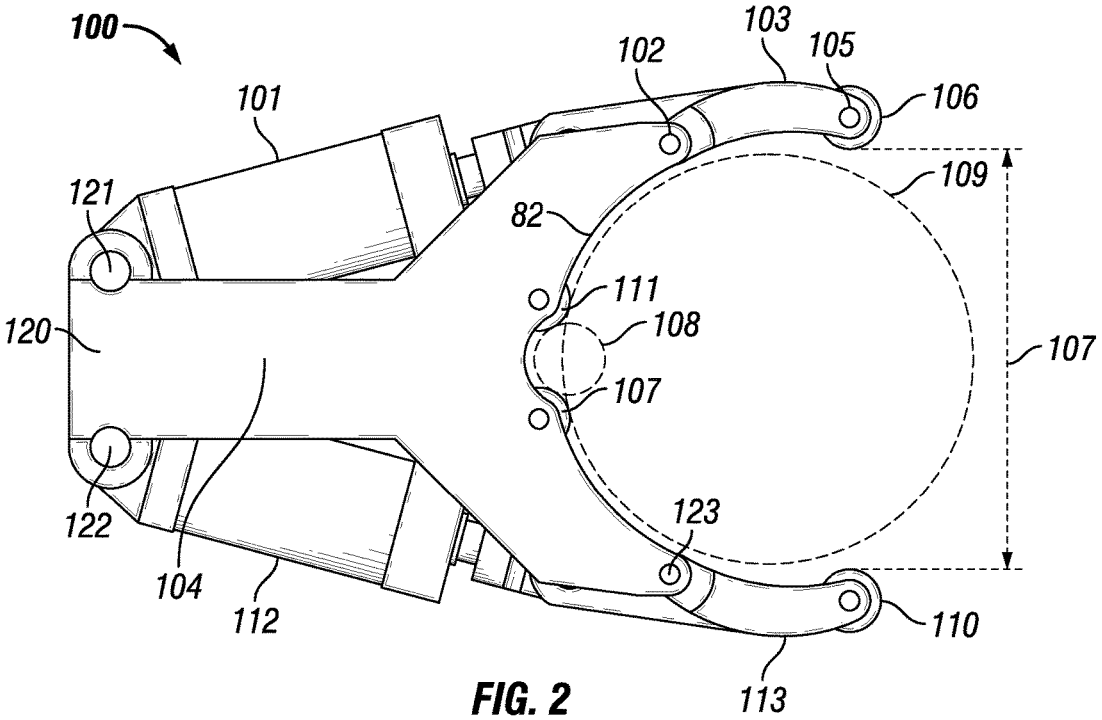
FIG. 2 is a top view of an example embodiment of a pipe gripper.
Figure 3:
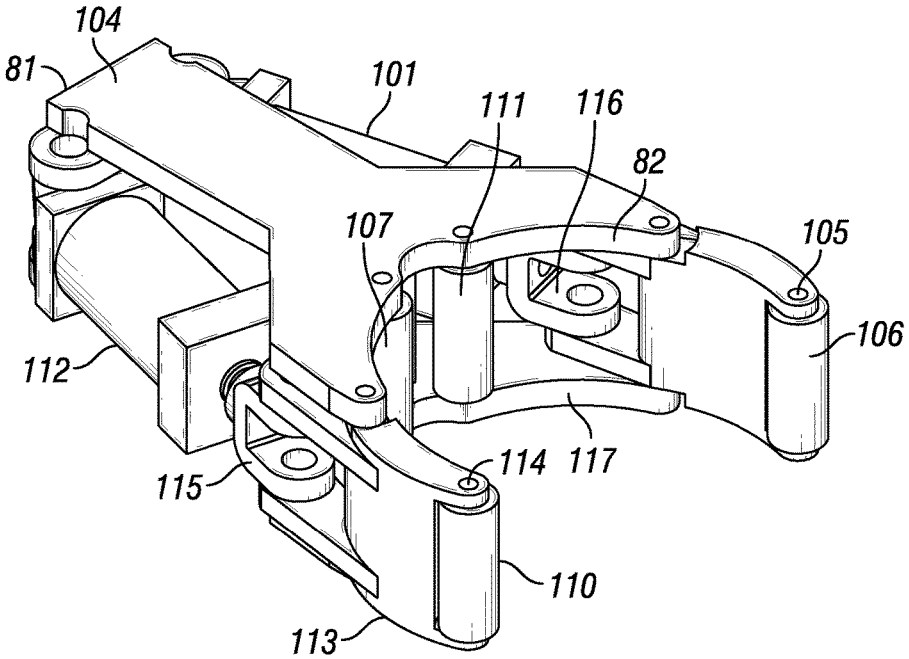
FIG. 3 is a perspective view of an example embodiment of a pipe gripper.

Referring to FIG. 2 and FIG. 3 an example gripper 100 is shown. The gripper 100 includes a y-shaped top plate 104 and a y-shaped bottom plate 117. Top plate 104 and bottom plate 117 each have a base end 81 and a gripper end 82. An actuator 101 is attached to the base end 120 via pin 121. A second actuator 112 is attached to the based end 120 via pin 122. Actuator 101 is attached to arm 103 via interface 116. Actuator 112 is attached to arm 113 via interface 115. Arm 103 is further attached to the top plate 104 and the bottom plate 117 via pivot pin 102. Pivot pin 102 in this example may include a bearing, bushing, or some other mechanical couple to facilitate the rotation of arm 103 about pivot pin 102. Arm 113 is further attached to the top plate 104 and the bottom plate 117 via pivot pin 123. Pivot pin 123 in this example may include a bearing, bushing, or some other mechanical couple to facilitate the rotation of arm 113 about pivot pin 123.

Continuing to refer to FIG. 2 and FIG. 3, arm 103 has a friction roller 106 attached at the end. The friction roller 106 is coupled to the arm via roller shaft 105. This allows the friction roller 106 to rotate independent of the arm 103. The friction roller 106 is adapted to engage a tubular 21 and apply sufficient frictional force supplied by actuator 101 to allow for the lifting of the tubular 21. Arm 113 has a friction roller 110 attached at the end. The friction roller 110 is coupled to the arm via roller shaft 114. This allows the friction roller 110 to rotate independent of the arm 113. The friction roller 110 is adapted to engage a tubular 21 and apply sufficient frictional force supplied by actuator 112 to allow for the lifting of the tubular 21. In addition, two additional friction rollers 107 and 111 are mounted to the top plate 104 and bottom plate 117.

Continuing to refer to FIG. 2 and FIG. 3, friction rollers 107, 111, 106, and 110 work together to provide sufficient friction against tubular 21 to allow the pipe handler 10 to lift, rotate, and manipulate the tubular 21. The tubular 21 may also be spun about its center axis while being gripped. The orientation of the friction rollers 107, 111, 106, and 110 and the shape of arms 103 and 113 allow for the gripper 100 to engage a variety of tubulars with outer diameters ranging from at least 3.5 inches to 20 inches. This large range of possible sizes allows the gripper to engage a variety of tubulars including pipe, drill pipe, casing, production tubing, make up stands, drill collars, joints, and downhole tools covering most circumstances occurring on drilling rigs. In this example a 20 inch outer diameter tubular 109 is shown alongside a 3.5 inch outer diameter tubular 108.

Figure 4A:
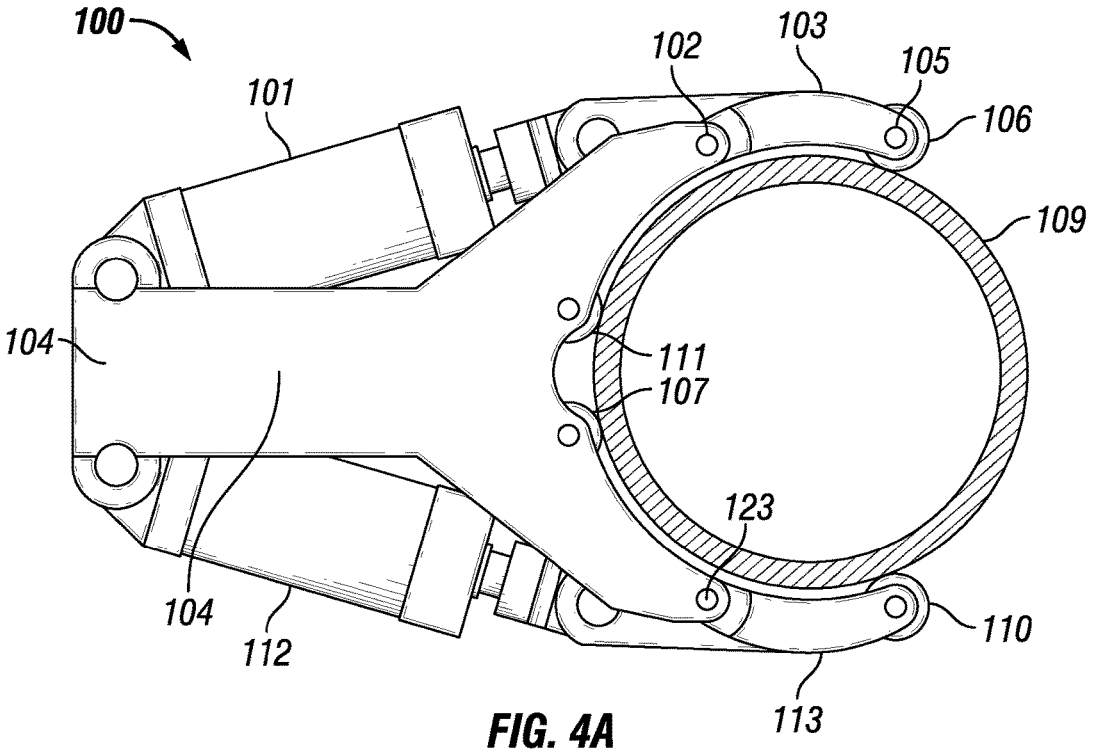
FIG. 4A is a top view of an example embodiment of a pipe gripper engaged to a large diameter tubular.

For example, in FIG. 4A the gripper 100 is shown engaging tubular 109. Tubular 109 has an outer diameter of 20 inches. In this example the actuators 101 and 112 exert a compressive force, pushing the arms 103 and 113 about their respective pivot points 102 and 123. The friction rollers 106, 107, 110, and 111 engage the tubular 109. Sufficient force is applied to prevent the tubular 109 from sliding vertically through the grip. However, the rollers 106, 107, 110, and 111 allow the tubular to be spun about its center axis as needed in oilfield operations, such as when connecting two threaded pipe sections. The top plate 104 must be sufficiently strong to handle the various forces needed to pick up the tubular 109, rotate the entire tubular from a horizontal position to a vertical position, or vice versa, without allowing the tubular 109 to slide through arms 103 and 113. Furthermore, the tubular 109 is free to rotate about its center axis while being gripped.

Figure 4B:
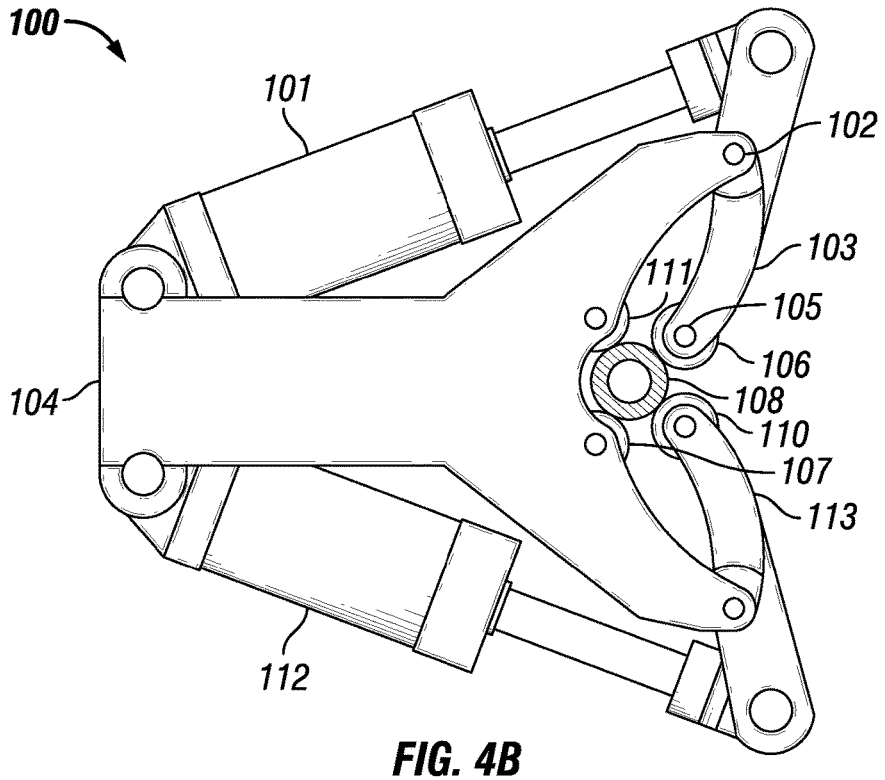
FIG. 4B is a top view of an example embodiment of a pipe gripper engaged to a small diameter tubular.

In another example, as shown in FIG. 4B, the gripper 100 is shown engaging tubular 108. Tubular 108 has an outer diameter of 3.5 inches. In this example the actuators 101 and 112 exert a compressive force, pushing the arms 103 and 113 about their respective pivot points 102 and 123. The friction rollers 106, 107, 110, and 111 engage the tubular 108. Sufficient force is applied to prevent the tubular from sliding vertically through the grip. However, the rollers 106, 107, 110, and 111 allow the tubular 108 to be spun about its center axis as needed in oilfield operations, such when as connecting two threaded pipe stands. The top plate 104 must be sufficiently strong to handle the various forces needed to pick up the tubular 108, rotate the entire tubular from a horizontal position to a vertical position, or vice versa, without allowing the tubular 108 to slide through arms 103 and 113. Furthermore, the tubular 108 is free to rotate about its center axis while being gripped.

In the various examples the actuators 101 and 112 are hydraulic, however, other forms of actuation are possible including pneumatic, servo motors, spring loaded mechanisms, or any other devices capable of exerting a tensile or compressive force.

Figure 5B:
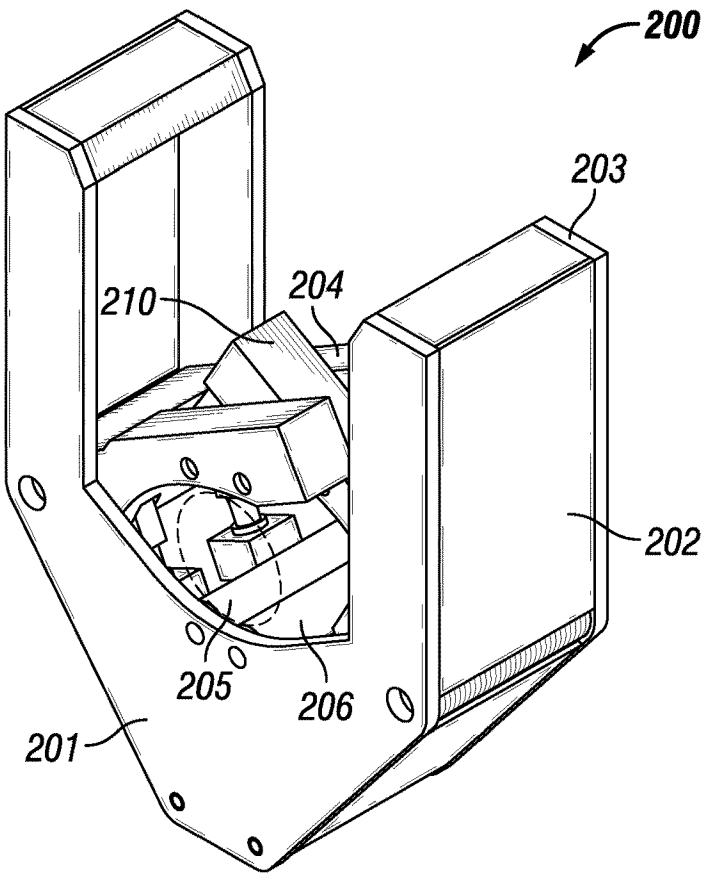
FIG. 5B is a top view of an example embodiment of a pipe gripper.
Figure 5A:
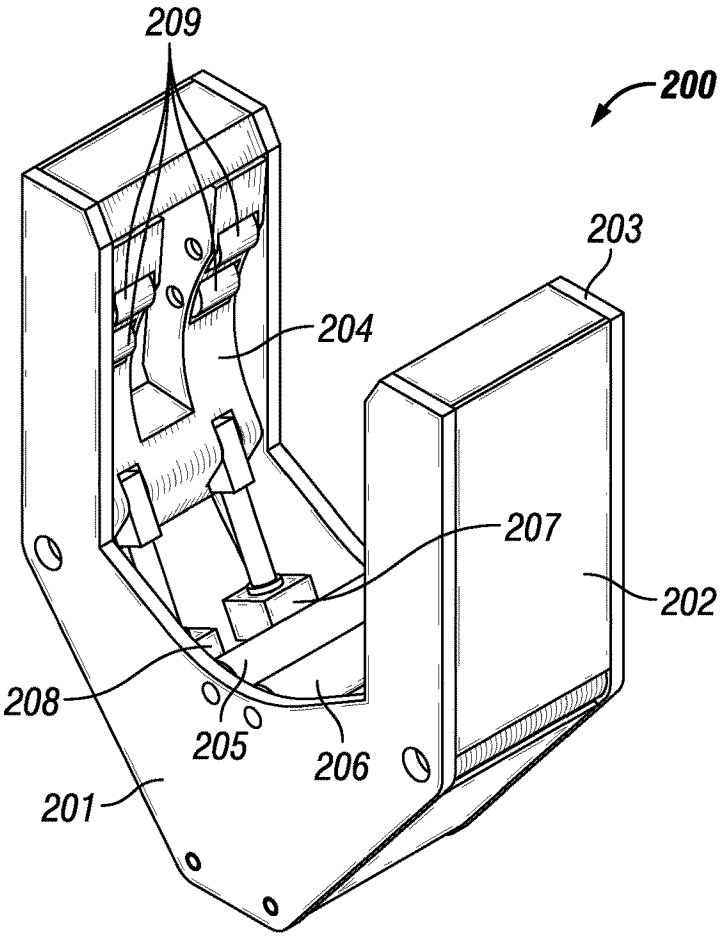
FIG. 5A is a perspective view of an example embodiment of a pipe gripper.
Figure 5C:
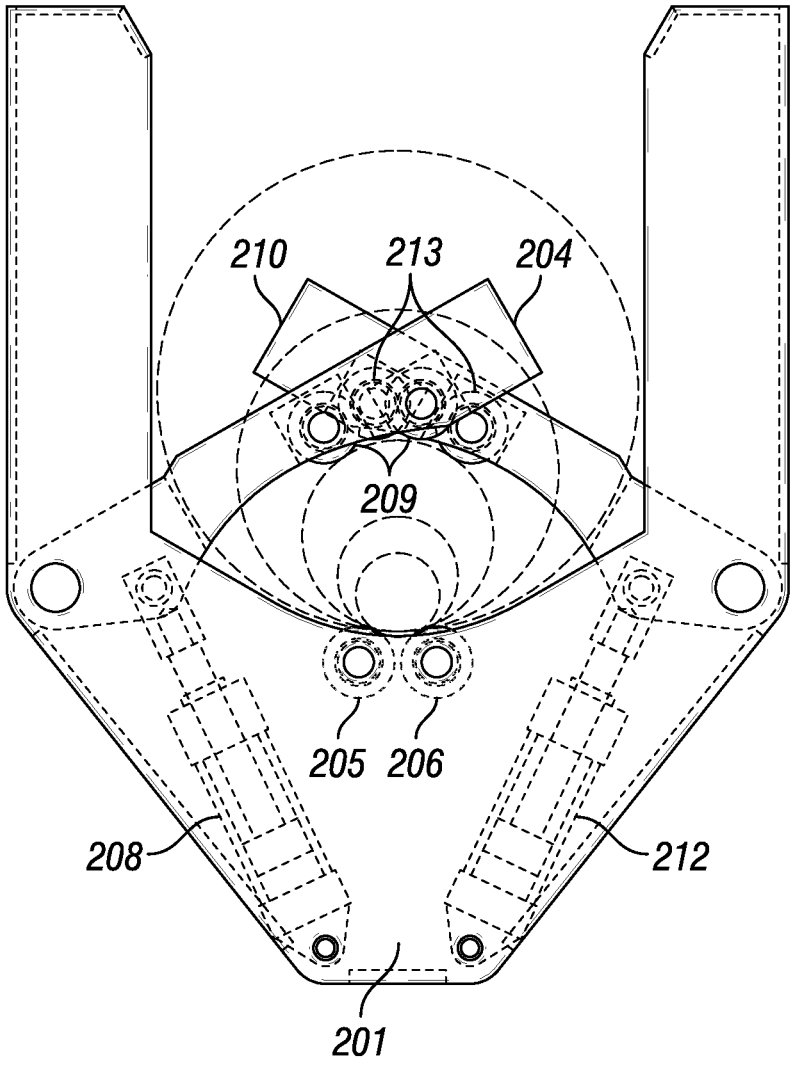
FIG. 5C is a perspective view of an example embodiment of a pipe gripper.

Another example of an alternative gripper 200 is shown in FIGS. 5A, 5B, and 5C. In this example a top plate 201 is mated to a bottom plate 203 via side plate 202. This collectively forms the gripper body. Friction rollers 205 and 206 are attached between the top plate 201 and the bottom plate 203. Actuators 207, 208, and 212 are shown. There are four actuators in this design total, two for each arm. The first arm 204 has two fingers while the second arm 210 has a single finger. A gap exists between the two fingers of first arm 204, allowing arm 204 and 210 to overlap and interlock as shown in FIG. 5B and FIG. 5C. In this example there are two actuators for each arm, however there could be more or fewer actuators than two per each arm. Furthermore, each arm does not necessarily require the same number or type of actuator. The first arm 204 has four friction rollers 209. It could have more or less than four friction rollers. The second arm 210 in this example has two friction rollers 213. In this design the gripper 200 is able to grip tubulars with outer diameters ranging from 3.5 inches to 20 inches. In this design the actuators pull the arms 204 and 210 into the body as opposed to other configurations shown that push the arms about a pivot. The advantage of pushing versus pulling is that in hydraulic cylinders greater forces can be generated because the push rod does not take up useable surface area inside the cylinder.

Figure 6A:
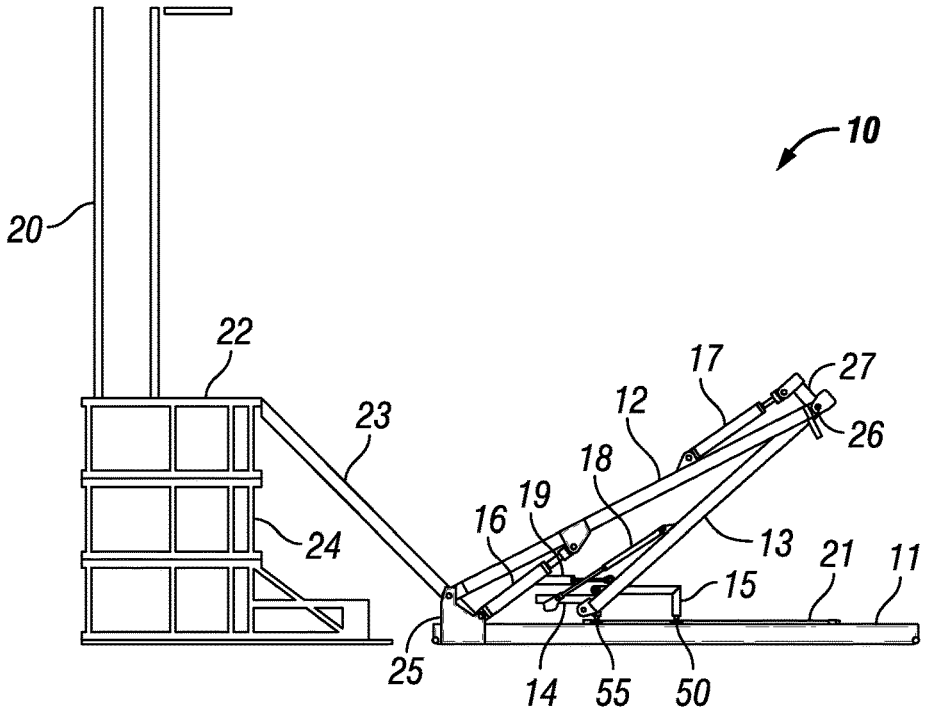
FIG. 6A is a side view of an example embodiment of a pipe handler.
Figure 6B:
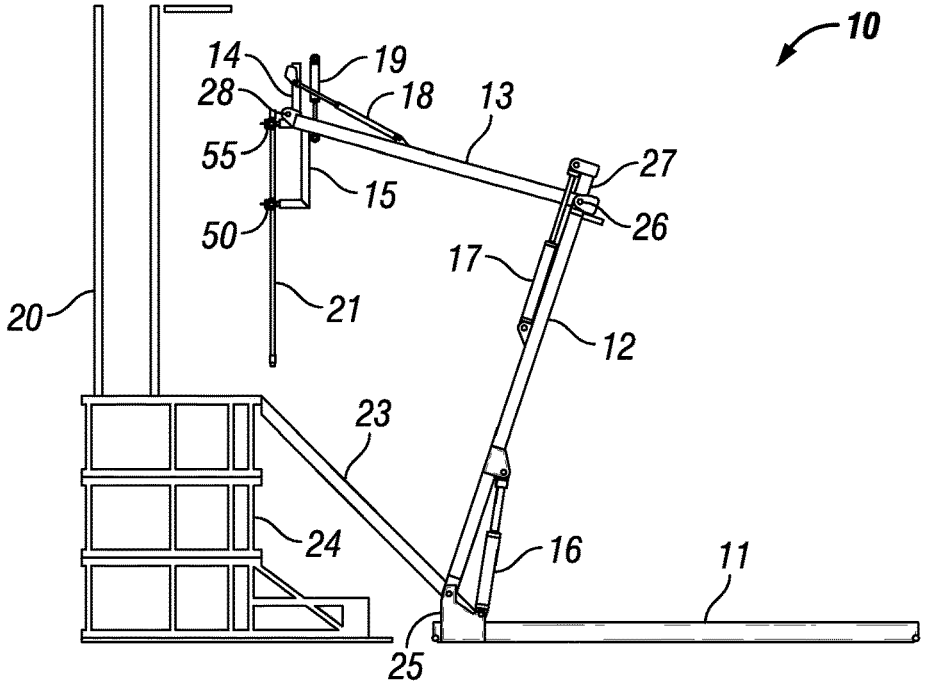
FIG. 6B is a side view of an example embodiment of a pipe handler.
Figure 6C:
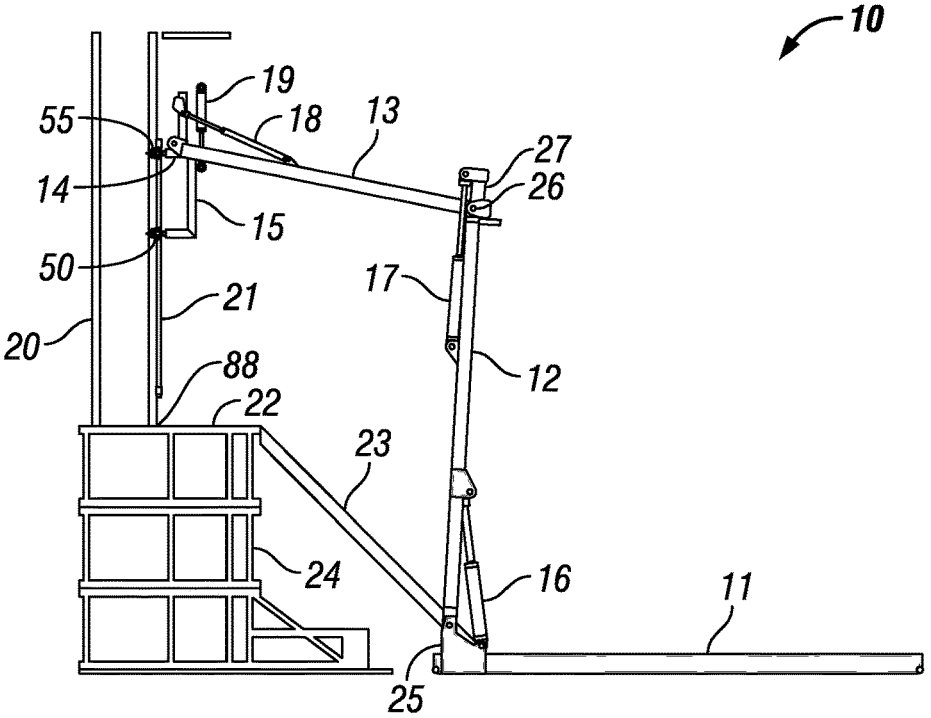
FIG. 6C is a side view of an example embodiment of a pipe handler.
Figure 6D:
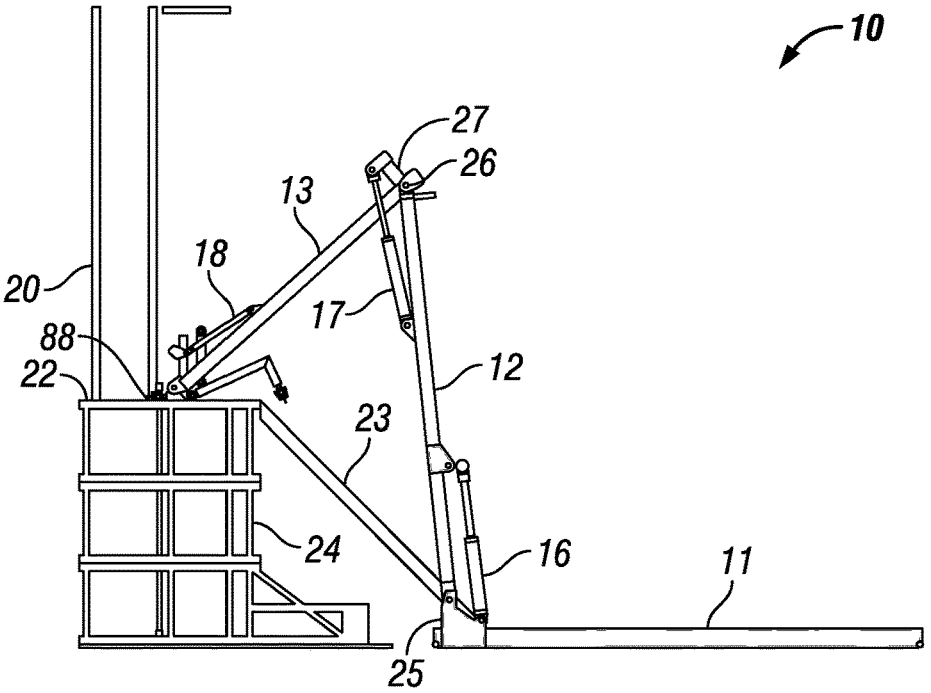
FIG. 6D is a side view of an example embodiment of a pipe handler.

Example operations of the pipe handler 10 are shown in FIGS. 6A, 6B, 6C, and 6D. In this example the pipe handler 10 grips horizontal tubular 21 in FIG. 6A and lifts it vertically off the skid 11, its first position, as shown in FIG. 6B. The pipe handler 10 then rotates the tubular 21 to a vertical position translates the tubular 21 towards the drill floor 22 as shown in FIG. 6B. This translation is accomplished by rotating leg 12 clockwise while moving body 13 and arm 14 to keep the tubular substantially vertical. The pipe handler 10 then aligns the tubular 21 at the desired target location, in this case a hole 88 in rig floor 22 as shown in FIG. 6C. The pipe handler 10 then lowers the tubular 21 into the hole 88 as shown in FIG. 6D. The grippers 50 and 55 then release the tubular 21 and leave it at its target location, hole 88. This process in reverse is used to remove tubulars from the hole 88.

Figure 7:
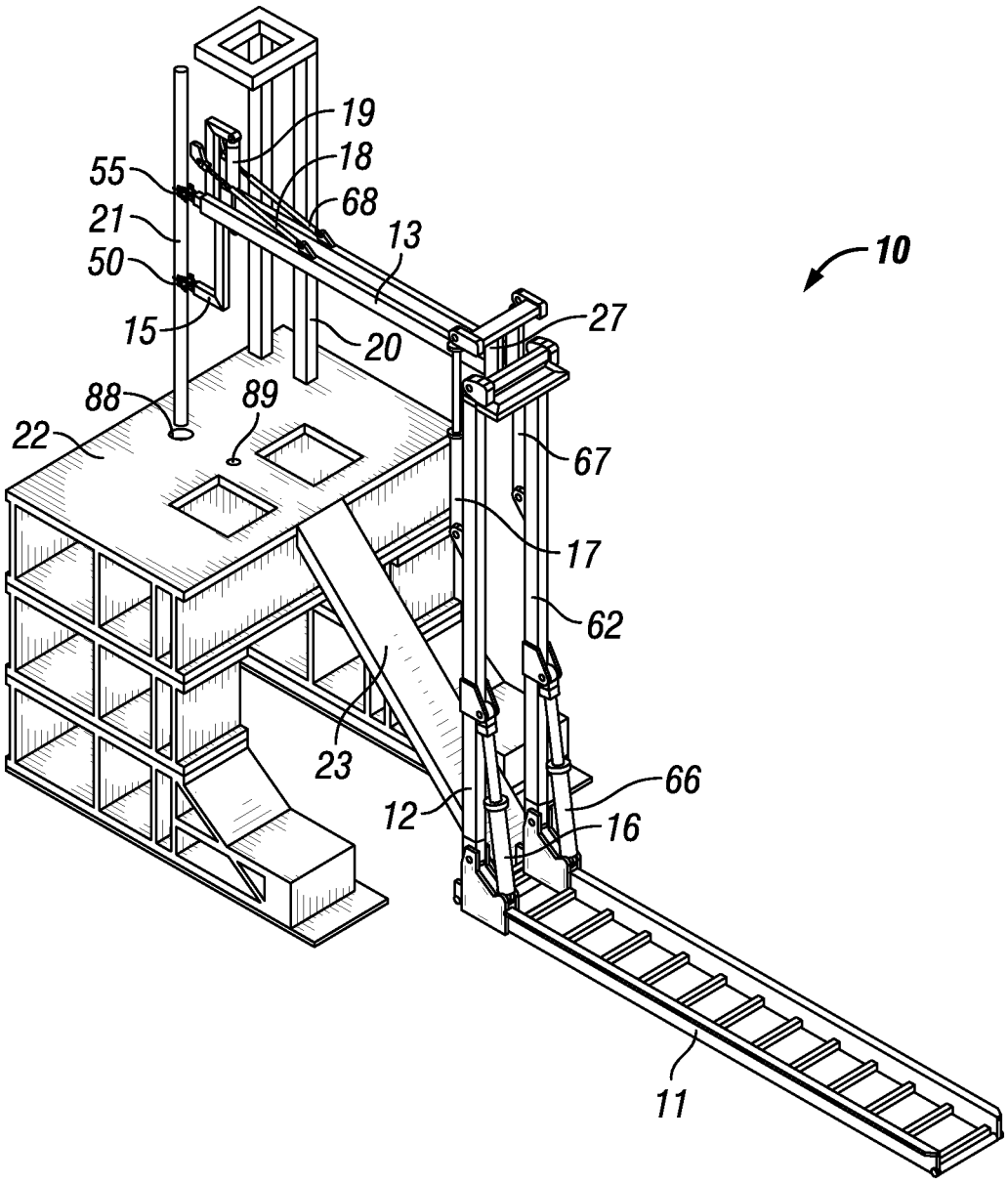
FIG. 7 is a perspective view of an example embodiment of a pipe handler.

A perspective view of pipe hander 10 is shown in FIG. 7. In this configuration actuator 16 is a plurality of actuators. Leg 12 is a plurality of legs 12 and 62. Actuator 17 is a plurality of actuators 17 and 67. Body 13 is composed of at least two beams. Actuator 18 is a plurality of actuators 18 and 68. Actuator 16 is a plurality of actuators 16 and 66. The skid 11 is wide enough to store multiple tubulars for use in oilfield operations. Furthermore, the process can be used to place tubulars in the mouse hole 89, move tubular 21 from the mouse hole 89 to the hole 88 or vice versa. The process can be used to move tubulars onto the rig floor 22 or off of the rig floor 22.

The actuators described herein are not intended to be limiting and may include any type of actuator including, but not limited to, hydraulic pistons, servo motors, pneumatic cylinders, electric actuator, shape memory alloys, or mechanical actuators.

The system disclosed herein may be controlled with one or more PLC's, computers, or microprocessors. The control system may be mounted to the pipe handler 10 itself or located at a separate location. Furthermore, the rig 24 may have the capabilities to control the plurality of actuators needed to run the pipe handler 10. In that case, software may be loaded onto the computing resources located at the rig 24 to control the pipe handler 10. Furthermore, the pipe handler 10 could be controlled remotely from a location separate from the rig 24. For instance, the pipe handler 10 could be operated from a facility onsite, but away from the rig, or it could be operated from a facility offsite entirely.

Uses of the pipe handler 10 may include running casing into a wellbore. The pipe handler 10 may be used to run drilling operations and add pipe stands to the drill string or take away pipe stands from the drill string. The pipe handler can ideally handle tripping pipe both into and out of the wellbore. It can further be used to handle and assemble tools, tubulars, and completions equipment. The pipe handler can lower downhole tools into the well and raise downhole tools from the well. The pipe handler can be used with pipe stands to convey downhole tools into or out of a wellbore. The pipe handler 10 may also be used to install completions tubulars into the well including casing, liners, expander tools, and other forms of completions tubulars.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for handling tubulars comprising:

a skid having a first end and a second end;

at least one leg having a lower end rotatingly coupled to the first end of the skid and an upper end;

at least one beam having a first end rotatingly coupled to the upper end of the at least one leg and being free to rotate about the coupling, a base end and a distal end;

a first actuator coupled to the skid, between the first end and the second end, and the at least one leg, between the lower end and the upper end;

a second actuator coupled to the at least one leg, between the upper end and the first actuator coupling, and the at least one beam, between the first end and the distal end;

an arm with a top end, a gripper end, a first pivot coupling located between the base end and the gripper end and coupled proximate to the distal end of the at least one beam;

a third actuator connected proximate to the top end of the arm and the at least one beam, between the first end and the distal end;

a tubular gripper attached to the gripper end of the arm adapted to grip a tubular; and a stabilizer bar having a coupled end connected to the arm proximate to the first pivot coupling of the arm and having a gripper end with a second tubular gripper attached therein.

2. The apparatus of claim 1, wherein the first tubular gripper and the second tubular gripper are parallel.

3. The apparatus of claim 1, further comprising a fourth actuator coupled to the stabilizer proximate to the coupled end and the arm proximate to the top end.

4. The apparatus of claim 1, wherein the plurality of actuators are hydraulic cylinders.

5. The apparatus of claim 1, where the at least one leg is a plurality of legs.

6. The apparatus of claim 1, wherein e at least one beam is a plurality of beams.

7. An apparatus for handling tubulars comprising:

An apparatus for handling tubulars comprising:

a skid having a first end and a second end;

at least one leg having a lower end rotatingly coupled to the first end of the skid and an upper end;

at least one beam having a first end rotatingly coupled to the upper end of the at least one leg and being free to rotate about the coupling, a base end and a distal end;

a first actuator coupled to the skid, between the first end and the second end, and the at least one leg, between the lower end and the upper end;

a second actuator coupled to the at least one leg, between the upper end and the first actuator coupling, and the at least one beam, between the first end and the distal end;

an arm with a top end, a gripper end, a first pivot coupling located between the base end and the gripper end and coupled proximate to the distal end of the at least one beam;

a third actuator connected proximate to the top end of the arm and the at least one beam, between the first end and the distal end;

a tubular gripper attached to the gripper end of the arm adapted to grip a tubular;

a bottom plate having a base end and a grip end;

a bottom plate having a base end and a grip end;

a top plate located parallel and substantially aligned with the bottom plate, and having a base end and a grip end;

a first grip arm with a first end and a second end, pivotally coupled to the bottom plate and the top plate, said first grip arm pivoting about a first axis located between the first and second ends;

a second grip arm with a first end and a second end, pivotally coupled to the bottom plate and the top plate, said second grip arm pivoting about a second axis located between the first and second ends;

a first actuator coupled proximate to the first end of the first grip, and further coupled proximate to the base ends of the bottom plate and the top plate; and a second actuator coupled proximate to the first end of the second grip, and further coupled proximate to the base ends of the bottom plate and the top plate;

at least one friction roller located at the second end of the first grip arm and being substantially perpendicular to the bottom plate and top plate;

at least one friction roller located at the second end of the second grip arm and being substantially perpendicular to the bottom plate and top plate; and a plurality of friction rollers located between the base ends of the top plate and the bottom plate and being substantially perpendicular to the bottom plate and the top plate.

8. The apparatus of claim 7, further comprising at least one friction roller proximate to the second end of the first grip arm and being substantially perpendicular to the bottom plate and top plate.

9. The apparatus of claim 8, wherein the at least one friction roller is a plurality of friction rollers.

10. The apparatus of claim 7, further comprising at least one friction roller proximate to the second end of the second grip arm and rotating around an axis that is substantially perpendicular to the bottom plate and top plate.

11. The apparatus of claim 10, wherein the at least one friction roller is a plurality of friction rollers.

12. The apparatus of claim 7, further comprising at least one friction roller located proximate between the grip ends of the top plate and the bottom plate.

13. The apparatus of claim 12, wherein the at least one friction roller located proximate between the grip ends of the top plate and the bottom plate is a plurality of friction rollers.

14. The apparatus of claim 13, wherein the first actuator and second actuator are hydraulic cylinders.

15. The apparatus of claim 7, wherein the grip arms are adapted to engage a tubular having a center axis and restraining axial movement along the center axis with respect to the first and second grip arms while providing rotational movement about the center axis.

16. An apparatus for handling tubulars comprising:

a skid having a first end and a second end;

at least one leg having a lower end rotatingly coupled to the first end of the skid and an upper end;

at least one beam having a first end rotatingly coupled to the upper end of the at least one leg and being free to rotate about the coupling, a base end and a distal end;

a first actuator coupled to the skid, between the first end and the second end, and the at least one leg, between the lower end and the upper end;

a second actuator coupled to the at least one leg, between the upper end and the first actuator coupling, and the at least one beam, between the first end and the distal end;

an arm with a top end, a gripper end, a first pivot coupling located between the base end and the gripper end and coupled proximate to the distal end of the at least one beam;

a third actuator connected proximate to the top end of the arm and the at least one beam, between the first end and the distal end; and a tubular gripper attached to the gripper end of the arm adapted to grip a tubular, wherein the at least one leg is a plurality of legs.

17. An apparatus for handling tubulars comprising:

a skid having a first end and a second end;

at least one leg having a lower end rotatingly coupled to the first end of the skid and an upper end;

at least one beam having a first end rotatingly coupled to the upper end of the at least one leg and being free to rotate about the coupling, a base end and a distal end;

a first actuator coupled to the skid, between the first end and the second end, and the at least one leg, between the lower end and the upper end;

a second actuator coupled to the at least one leg, between the upper end and the first actuator coupling, and the at least one beam, between the first end and the distal end;

an arm with a top end, a gripper end, a first pivot coupling located between the base end and the gripper end and coupled proximate to the distal end of the at least one beam;

a third actuator connected proximate to the top end of the arm and the at least one beam, between the first end and the distal end; and a tubular gripper attached to the gripper end of the arm adapted to grip a tubular; wherein the at least one beam is a plurality of beams.

* * * * *